United States Patent [19]

Penn

[11] 4,125,966

[45] Nov. 21, 1978

[54] ELECTRIC SECURITY DOOR AND UNITIZED FRAME

[76] Inventor: Robert E. Penn, R.R. 4, Rockville, Ind. 47872

[21] Appl. No.: 870,342

[22] Filed: Jan. 18, 1978

[51] Int. Cl.[2] ..... E05F 11/38

[52] U.S. Cl. ..... 49/378; 49/349; 49/351; 49/363; 49/380

[58] Field of Search ..... 49/323, 360, 349, 351, 49/372, 378, 380, 363

[56] References Cited

U.S. PATENT DOCUMENTS

| | | | |
|---|---|---|---|
| 1,221,766 | 4/1917 | Pitcher | 49/380 X |
| 1,583,835 | 5/1926 | Hynes | 49/363 |
| 1,643,064 | 9/1927 | Elliott | 49/363 |
| 2,026,886 | 1/1936 | Goeltz et al. | 49/380 X |
| 3,009,984 | 11/1961 | Lindgren | 49/372 X |
| 3,266,204 | 8/1966 | Andrews | 49/349 |

*Primary Examiner*—Philip C. Kannan

[57] ABSTRACT

A unitized frame housing a slidable door. The main body of the frame is a single molded structure fittable between a pair of walls within a building. Guide means provided within the main body slidably receives a door which is opened and closed by an electric motor. Various linkages and gears connect the electric motor to the door. A neck integrally attached to the main body extends outwardly of the building walls housing the main body of the frame forms a passageway allowing access through the building walls and main body when the door is not closed. The neck flares outwardly providing a trim portion which seats outwardly of the building walls facilitating a smooth boundary between the building and neck. Means are provided for securing the unitized main body to the building.

2 Claims, 7 Drawing Figures

ELECTRIC SECURITY DOOR AND UNITIZED FRAME

BACKGROUND OF THE INVENTION

1. Field of the Invention

This invention is in the field of building construction and more specifically, sliding doors.

2. Description of the Prior Art

A variety of electrically operated slidable doors have been provided to achieve a variety of objectives. For example, the automatic doors of an elevator are slidably mounted and disappear into the main walls of the building when opened. Likewise, the typical overhead garage door of a home is slidably mounted and may be operated by an electric motor/worm gear combination. Nevertheless, even in view of all of the slidable doors provided to date, a burglar-proof and wind-proof door which is slidably mounted has not been provided. Typically, a door may be opened by jamming a tool between the door and the frame housing the door. Disclosed herein is a housing having a slidably mounted door with the housing being of unitized construction precluding or reducing the opportunity to remove a single piece from the door housing so as to eventually pry open the door. Likewise, the housing disclosed herein is of one-piece construction providing a more secure seal with the door providing an air-tight seal between the door and housing.

SUMMARY OF THE INVENTION

One embodiment of the present invention is the combination installable in a building having interior and exterior side-by-side walls of a single unitized structure including a doorway portion defining an opening and a storage portion integrally joined together, a single door slidably mounted to the structure, drive means associated with the structure and the door and operable to move the door from an open position within the storage portion to a closed position within the doorway portion, guide means within the structure and extending across the doorway portion and into the storage portion and sized receiving the door being operable to guide the door as the drive means open and closes the door, wherein the improvement comprises, the structure includes a doorway trim integral with the doorway portion with the trim extending outwardly of and adjacent the exterior wall when the structure is mounted to the building, the storage portion contains the drive means, a portion of the guide means and the door when open and is sized to fit completely between the exterior wall and the interior wall.

It is an object of the present invention to provide a new and improved slidably mounted door.

Yet another object of the present invention is to provide a burglar-proof housing for a door wherein the housing is of a unitized integral one-piece construction.

Related objects and advantages of the present invention will be apparent from the following description.

DESCRIPTION OF THE PREFERRED EMBODIMENT

Figure 1:
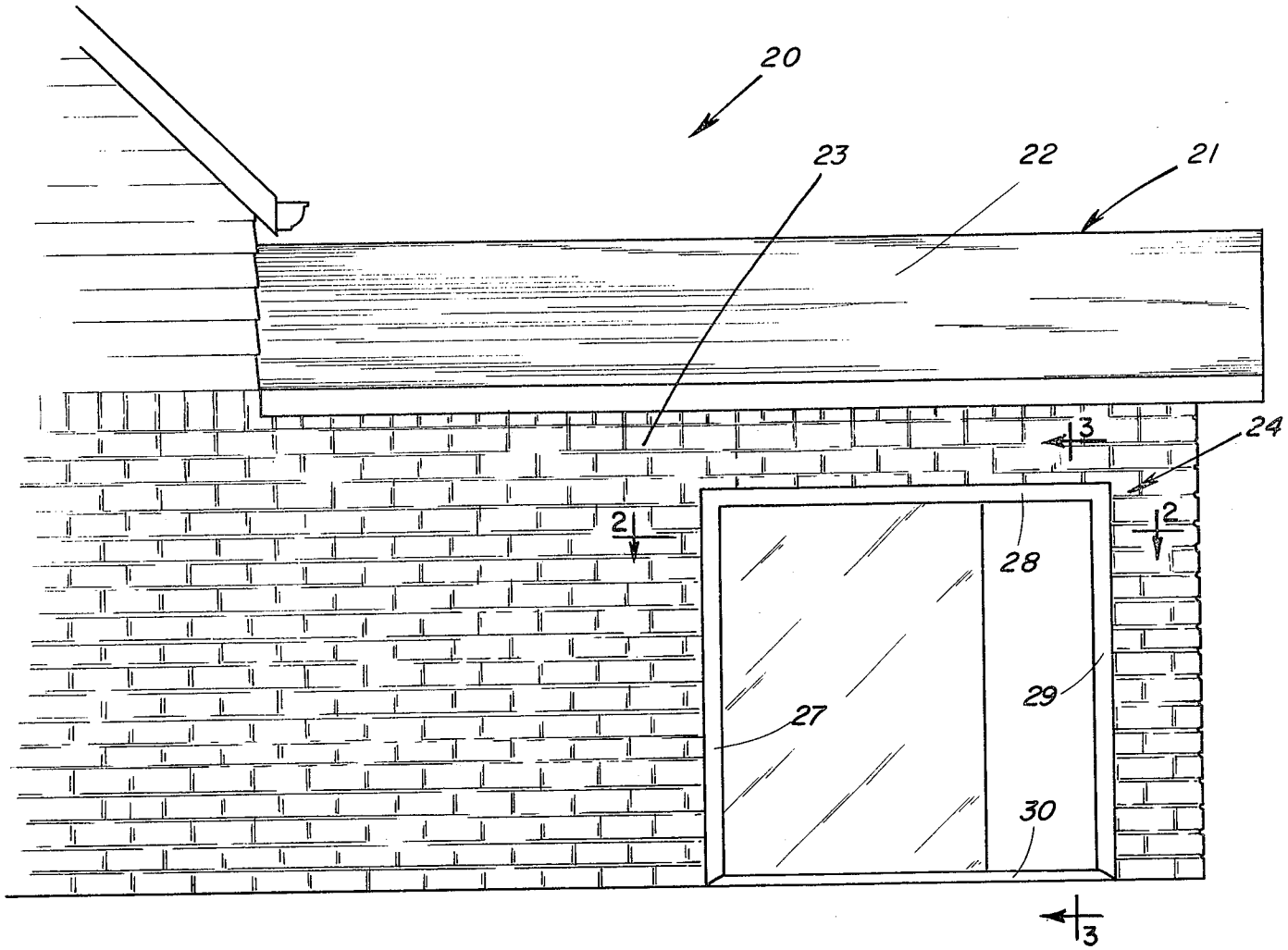
FIG. 1 is a fragmentary front view of a building showing a door construction incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a portion of a house 20 having a garage 21 with conventional roof 22 and an outside wall 23 constructed from a material, such as brick. A garage door opening 24 is shown with the garage door in the partially closed position providing a small opening of sufficient size, for example, for a person to walk through. A pair of trim portions 27 and 29 are integrally joined to a top trim portion 28 and rest against the external wall 23 of the building. A rain guide 30 is integrally joined to trim portions 27 and 29 and rest atop the ground. Both the trim portions and the rain guide will be described later in the specification.

Figure 4:
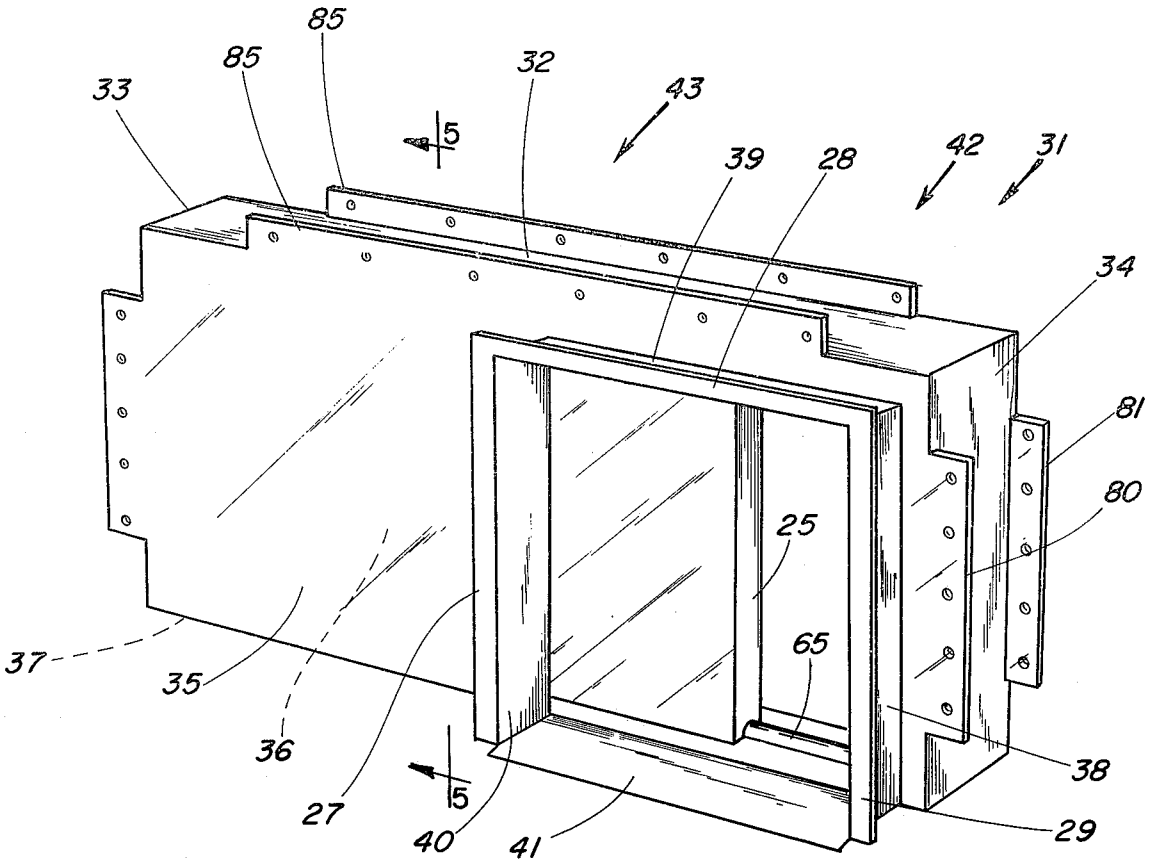
FIG. 4 is a perspective view of the slidably mounted door and housing incorporating the present invention with the housing and door being removed from the building shown in FIG. 1.

A perspective view of the door housing in shown in FIG. 4. Housing 31 includes end walls 33 and 34 integrally joined to a pair of side walls 35 and 36 in turn integrally joined to the top wall 32 and bottom wall 37 forming an elongated box. A neck is formed by walls 38 through 41 which in turn are integrally joined to the front wall 35 of housing 31. The neck forms a passageway opening into housing 31 with the passageway being closable by door 25. Housing 31 is a single unitized structure including an end portion 42 forming the doorway or passage formed by walls 38 through 41 and further includes a storage portion 43 wherein the door is stored in the open position along with the drive means for opening and closing the door.

Figure 6:
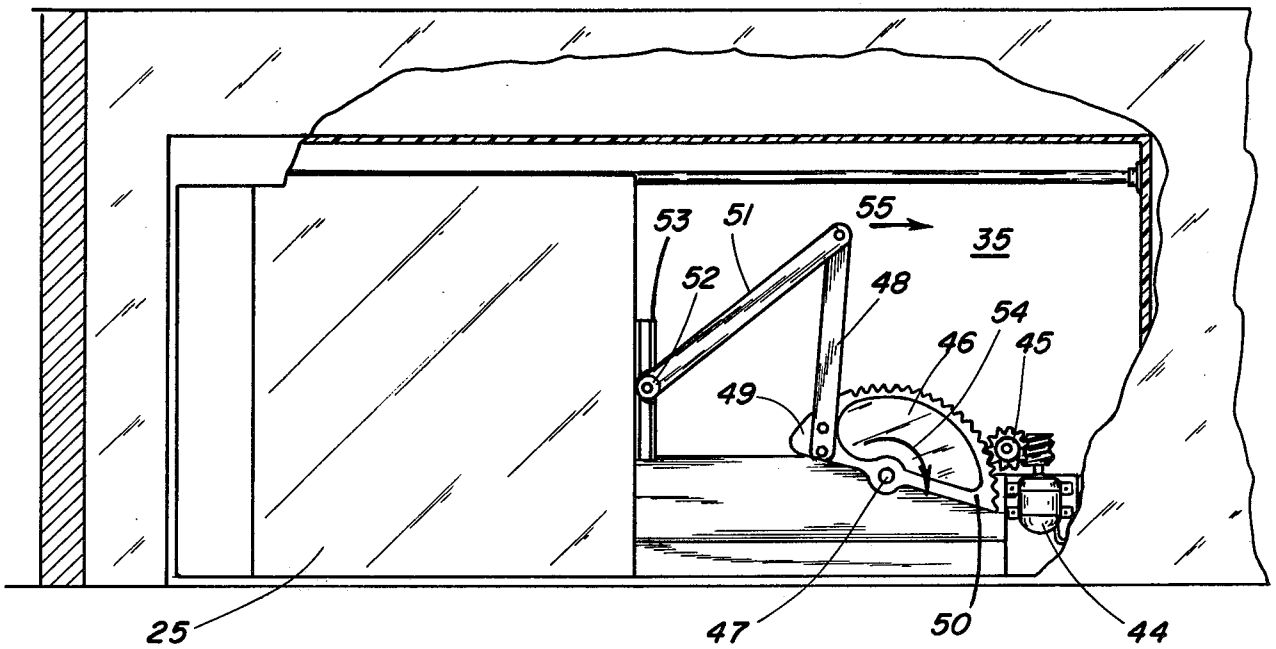
FIG. 6 is a fragmentary rear view of the door shown in FIG. 1 with the door shown in the partially open position.
Figure 7:
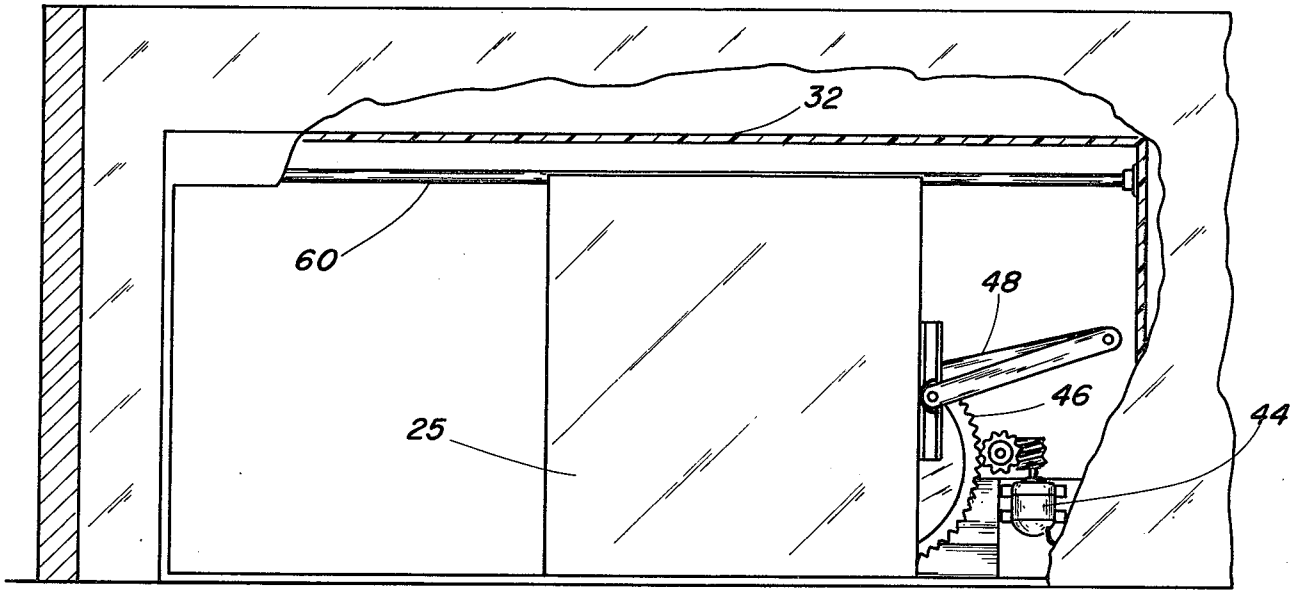
FIG. 7 is the same view as FIG. 6 only showing the door in the completely open position.

Door 25 is slidably mounted within the housing and is opened and closed by a drive means associated with the housing and the door. Drive means includes an electric motor 44 (FIG. 6) mounted to the front wall 35 of the door housing. Motor 44 includes an output shaft operatively engaged with a rotatably mounted gear 45 in turn engaged with a half-moon shaped gear 46 pivotally mounted by pin 47. Link 48 has a bottom end mounted to end 49 of gear 46 which is located opposite end 50 of gear 46 engaged with gear 45 when the door is in the closed position. The top end of link 48 is pivotally mounted to one end of link 51 having an opposite end with a rotably mounted follower 52 slidably received by slide 53 fixedly mounted to door 25. To open door 25, motor 44 is energized so as to cause gear 46 to pivot in the direction of arrow 54 thereby causing links 51 and 48 to move in the direction of arrow 55 so as to pull door 25 to the completely open position as shown in FIG. 7. Door 25 may be closed by activating motor 44 so as to cause gear 46 to pivot in the direction opposite of arrow 54 thereby moving door 25 and links 48 and 51 in the direction opposite of arrow 55. Motor 44 is connected to a suitable source of electrical energy with a conventional switch provided to allow a person to activate and deactivate the electric motor. For example, a locking push button may be provided outside of the building which will activate only upon receipt of a appropriate configured key. Likewise, a push button may be provided on the inside of the building to activate and deactivate the electric motor.

Figure 3:
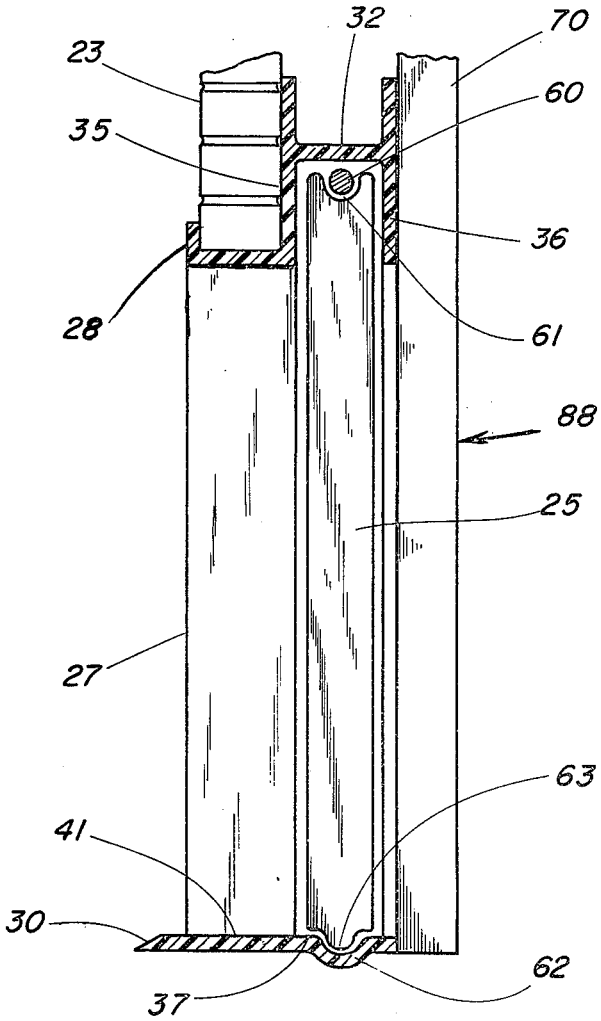
FIG. 3 is an enlarged fragmentary cross-sectional view taken along the line 3—3 of FIG. 1 and viewed in the direction of the arrows.

Guide means are provided within said structure which extend across the doorway portion of the housing and into the storage portion of the housing being sized to receive the door and being operable to guide the door as the drive means open and closes the door. Two different guide means are shown in the drawings. The preferred guide means is shown in FIG. 3 and includes a rod 60 having its opposite ends fixedly secured to the end walls 33 and 34 of the housing. Door 25 is provided with a groove 61 having a plastic coating or slide provided therein to slidably receive rod 60. In addition, a groove 62 is provided in the bottom wall 37 of the housing and slidably receives a rounded projection 63 provided on the bottom edge of door 25. A suitable plastic covering may be provided on projection 63 and within groove 62 to facilitate the sliding motion of the door relative to the housing.

Figure 5:
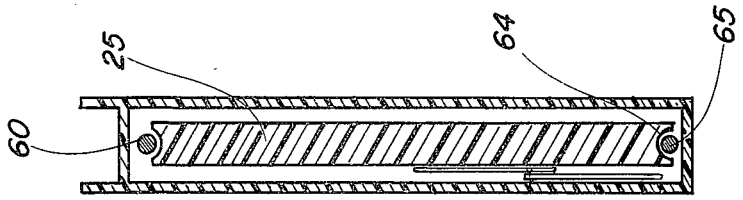
FIG. 5 is an enlarged cross-sectional view taken along the line 5—5 of FIG. 4 and viewed in the direction of the arrows.

An alternate guide means is shown in FIG. 5 and is identical to the guide means shown in FIG. 3 with the exception that the bottom edge of the door is provided with a groove 64 to slidably receive a second rod 65 having its opposite ends fixedly secured to the end walls 33 and 34 of the housing.

Trim 27, 28 and 29 are integrally attached to walls 40, 39 and 38 (FIG. 4) which in turn are integrally attached to wall 35 of housing 31. Trim 27-29 extend outwardly of and adjacent the exterior wall 23 of the building when the door and door housing are mounted to the building. The storage portion 43 of housing 31 includes and contains the drive means previously described along with a portion of the guide means or guide rails and also the storage portion contains the door when in the open position. Housing 31 is sized to fit completely between the exterior wall 23 and interior wall 70 (FIG. 3) of the building. It is therefore intended that the construction disclosed be installed in the building when the building is initially constructed; however, it is understood that the device disclosed herein may be installed into a completed building, assuming a portion of the interior wall is first removed.

Figure 2:
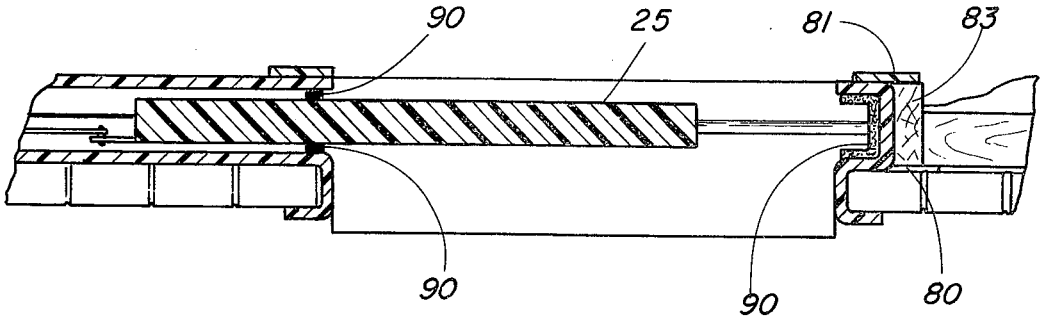
FIG. 2 is an enlarged fragmentary cross-sectional view taken along the line 2—2 of FIG. 1 and viewed in the direction of the arrows.

A pair of spaced apart and parallel brackets 80 and 81 (FIG. 4) extend outwardly and to the side of the doorway portion 42 and end wall 34 with brackets 80 and 81 being parallel with the guide means or guide rods 60 and 65. Brackets 80 and 81 are adapted to fittingly receive and fasten to a wooden beam 83 (FIG. 2) of the building. Likewise, a second pair of brackets are provided adjacent end wall 33 (FIG. 4) of the housing to facilitate the securing of housing 31 to the building. Additional brackets 85 may be provided at the top and bottom edges of housing 31. Each of the brackets are provided with suitable nail holes allowing for securing housing 31 to the building.

Wall 41 (FIG. 3) extends outwardly forming rain guide 30 which is positioned atop the ground outwardly of the trim. Back wall 36 (FIG. 3) is provided with an opening 88 aligned and of equal size with the passageway formed by walls 38-41 (FIG. 4) allowing a vehicle to pass through the passageway and housing 31 when the door 25 is in the open position.

The construction disclosed herein includes a variety of advantages as compared to prior doorway constructions. For example, a novel method of enclosing and opening in a building is provided and includes the steps of inserting the housing 31 with door 25 previously described and shown in FIG. 4 within a building and then operating the drive means to open and close the door. The construction is particularly advantageous in that the entire housing may be slipped or inserted between a pair of walls and then fixedly secured thereto without the normal on-site construction of a doorway opening and guide means. Thus, the construction disclosed herein may be assembled and produced at a site remotely located from the construction site. It will be obvious from the above description that the present invention provides a unitized and integral doorway frame having external trim integrally connected to the portion of the frame housing the doorway. Such a construction precludes the easy removal of a board or other portion such as found in the conventional doorway to facilitate the prying of the door from the frame. Likewise, a particularly good air-tight seal is provided between the door and frame. Suitable seals such as felt cloth 90 (FIG. 2) may be provided so as to surround the doorway thereby contacting door 25.

Many variations are contemplated and included in the present invention. For example, the door may be opened by a variety of electrical means operating off either AC or DC current. The door may be made of any shape or size and may be either an exterior or an interior door. A variety of sizes may be provided for the opening. A particular advantage of the construction disclosed herein is that the door does not require any hardware such as doorknobs and hinges. Likewise, in lieu of utilizing the linkage gear combination shown in the drawings, it is possible to open and close the door by a variety of means such as a scissor linkage combined with suitable drive means. The construction disclosed herein is particularly adapted to being molded as a single plastic unit or of any moldable material such as steel, fiberglass, etc. The particular construction disclosed herein alleviates any problems associated with warping, upkeep or maintenance. Such construction may be also used for skylights in addition to conventional doorways.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A construction installable in a building having interior and exterior side-by-side walls comprising:

a single unitized structure including a front wall, back wall, top and bottom walls and a pair of end walls integrally joined together in a box configuration with a doorway portion defining an opening and a storage portion integrally joined together, said storage portion sized to fit completely between said exterior wall and said interior wall;

a single door slidably mounted to said structure and having an edge portion with a groove extending thereacross;

drive means enclosed within said storage portion of said structure and being operably connected with said door to move said door from an open position within said storage portion to a closed position within said doorway portion, said drive means including a slot frame on said door with a follower slidably mounted therein, said drive means further including a linkage connected to said follower and a gear connected to said linkage, said drive means also including a motor mounted within said unitized structure and operatively engaged with said gear to move said linkage and follower to open and close said door;

guide means within said structure and including at least one rod extending across said doorway portion and into said storage portion and fitting within said groove of said door to guide said door as said door slides on said rod as said drive means opens and closes said door;

said unitized structure further including a neck forming a passageway leading into said doorway portion and aligned with said opening, said neck including a pair of mutually opposed and spaced apart vertical side walls extending perpendicularly from and joined to said front wall with said neck including a horizontally extending ceiling wall and a floor wall extending between and joined to said pair of side walls, said neck having a flared portion extending outwardly from said side walls and ceiling wall in a parallel arrangement with said front wall forming a pocket extending at least partially around said neck to receive said exterior wall, said floor wall extending outwardly of said flared portion and atop ground forming a rain guide and having an outer downwardly sloping edge, said floor wall extending through said neck to said bottom wall being a one-piece construction with a portion of said guide means being provided on said bottom wall;

said pair of side walls being located inwardly of said end walls and being joined thereto by said front wall providing an air-tight and jam-proof seal when said door is in the closed position, one of said end walls together with a portion of said back wall and front wall forming a channel adjacent to but opening in a reverse direction to a portion of said pocket formed by said flared portion, front wall and side wall which is nearest said channel.

2. The construction of claim 1 wherein said single unitized structure is a one-piece plastic construction.

* * * * *